US007913772B2

(12) United States Patent
Sherrill et al.

(10) Patent No.: US 7,913,772 B2
(45) Date of Patent: Mar. 29, 2011

(54) DRILLING FLUID FLOW DIVERTER

(75) Inventors: Kristopher V. Sherrill, Humble, TX (US); James E. Stone, Porter, TX (US); Richard D. Bottos, Hockley, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 146 days.

(21) Appl. No.: 12/304,101

(22) PCT Filed: Jun. 11, 2007

(86) PCT No.: PCT/US2007/070902

§ 371 (c)(1),
(2), (4) Date: Dec. 9, 2008

(87) PCT Pub. No.: WO2007/146889

PCT Pub. Date: Dec. 21, 2007

(65) Prior Publication Data

US 2010/0243265 A1 Sep. 30, 2010

Related U.S. Application Data

(60) Provisional application No. 60/804,405, filed on Jun. 9, 2006.

(51) Int. Cl.
*E21B 43/00* (2006.01)

(52) U.S. Cl. ..... 175/24; 175/232; 175/317; 175/318

(58) Field of Classification Search ..... 175/232, 175/317, 318, 24; 166/373, 386
See application file for complete search history.

(56) References Cited

U.S. PATENT DOCUMENTS 5,839,508 A 11/1998 Tubel et al.
6,019,182 A * 2/2000 Rountree et al. ..... 175/325.2
2009/0195250 A1 * 8/2009 Welshans et al. ..... 324/324

FOREIGN PATENT DOCUMENTS

GB 2402421 A 12/2004

OTHER PUBLICATIONS

PCT/US2007/070902 International Search Report, Jul. 30, 2008.
Intellectual Property Office of Singapore, Written Opinion for Singapore Application No. 200808726-4, Jan. 19, 2010.
Examination Report for Canadian Application No. 2,648,910, Feb. 8, 2010.

* cited by examiner

*Primary Examiner* — William P Neuder
(74) *Attorney, Agent, or Firm* — Conley Rose, P.C.

(57) ABSTRACT

An embodiment of the apparatus includes a housing having a first flow bore and a second flow bore, the first flow bore having a drilling fluid flowing therein, a device disposed in the second flow bore to receive a fluid flow, and a diverter disposed between the first and second flow bores, the diverter having a first position preventing the drilling fluid from flowing into the second flow bore and a second position allowing a portion of the drilling fluid to flow into the second flow bore and through the device. Another embodiment includes a variable second position directing the drilling fluid into the second flow bore at a variable flow rate. A further embodiment includes a drill collar as the housing and a power generation assembly as the device to receive the fluid flow. Embodiments of a method of diverting a fluid flow in a downhole tool include diverting a portion of a first fluid flow to a second flow bore, and further varying a flow rate of the fluid to the second flow bore.

21 Claims, 10 Drawing Sheets

DRILLING FLUID FLOW DIVERTER

This application claims the benefit of U.S. Provisional Application Ser. No. 60/804,405, filed Jun. 9, 2006 and entitled "LWD Fluid Identifier."

BACKGROUND

During the drilling and completion of oil and gas wells, it may be necessary to engage in ancillary operations, such as monitoring the operability of equipment used during the drilling process or evaluating the production capabilities of formations intersected by the wellbore. For example, after a well or well interval has been drilled, zones of interest are often tested to determine various formation properties. These tests are performed in order to determine whether commercial exploitation of the intersected formations is viable and how to optimize production. In addition to formation testers, other tools for ancillary operations may include a measurement while drilling (MWD) or logging while drilling (LWD) tool, a reamer, a stabilizer or centralizer having moveable or extendable arms, a MWD coring tool with an extendable member, a fluid identification (ID) tool, and others. These tools for ancillary operations to drilling a borehole typically require a power source to drive the various components and devices. Many times, the power source is incorporated into the downhole tool, as opposed to being located at the surface of the well.

In some tools, batteries provide power to operate all aspects of the tool. When the batteries are depleted, they are disposed. However, batteries provide a very limited supply of energy and cannot sustain devices that draw heavily on the power source. In some simple devices, such as a mud pulse generator, a turbine is used to generate power for the mud pulser. The turbine is disposed in the drilling fluid flow bore and rotated by the drilling fluid flowing therein. The drilling fluid is constantly flowing over the turbine, providing a steady source of wear on the turbine.

New tools, such as those included with MWD or LWD systems, formation testers or fluid ID systems, for example, are increasing in size, complexity and functionality. These tools require robust and adaptable power sources. The tool may include an electric valve or electronic processor that requires a relatively small amount of power, while also including one or more hydraulically extendable devices that requires a larger burst of hydraulic power. These components of the tool may be selectively usable at different times, and may require varying levels of power during use. The tool's downhole power source must accommodate these power requirements. The tool, if it is disposed on a drill string, may be deployed in the well for long periods of time, restricting maintenance access. Preservation of moving and other active parts is critical. However, complex downhole tools are pushing the limits of current power generation assemblies, flow components and other supporting devices.

SUMMARY

An embodiment of the apparatus includes a housing having a first flow bore and a second flow bore, the first flow bore having a drilling fluid flowing therein, a device disposed in the second flow bore to receive a fluid flow, and a diverter disposed between the first and second flow bores, the diverter having a first position preventing the drilling fluid from flowing into the second flow bore and a second position allowing a portion of the drilling fluid to flow into the second flow bore and through the device.

Another embodiment of the apparatus includes a drill collar having a first flow bore and a second flow bore, the first flow bore having a drilling fluid flowing therein, a power generation assembly disposed in the second flow bore, and a flow diverter isolating the drilling fluid from the second flow bore in a first position, wherein the flow diverter includes a variable second position directing the drilling fluid into the second flow bore at a variable flow rate.

A further embodiment of the apparatus includes a drill collar having a first flow bore with a first drilling fluid flow therein, and a second flow bore isolated from the first drilling fluid flow and having a power generation assembly disposed therein, a flow diverter adapted to direct a variable second drilling fluid flow into the second flow bore, and an MWD tool coupled to the drill collar and the power generation assembly, wherein the variable second drilling fluid flow generates a variable power supply in the power generation assembly, the variable power supply providing substantially all power to the MWD tool.

An embodiment of a method of diverting a fluid flow in a downhole tool includes flowing a fluid through a first flow bore in the downhole tool, isolating the fluid from a second flow bore in the downhole tool, and diverting a portion of the fluid to the second flow bore. A further embodiment includes varying a flow rate of the fluid to the second flow bore.

BRIEF DESCRIPTION OF THE DRAWINGS

For a detailed description of exemplary embodiments of the invention, reference will now be made to the accompanying drawings in which.

DETAILED DESCRIPTION

Figure 1:
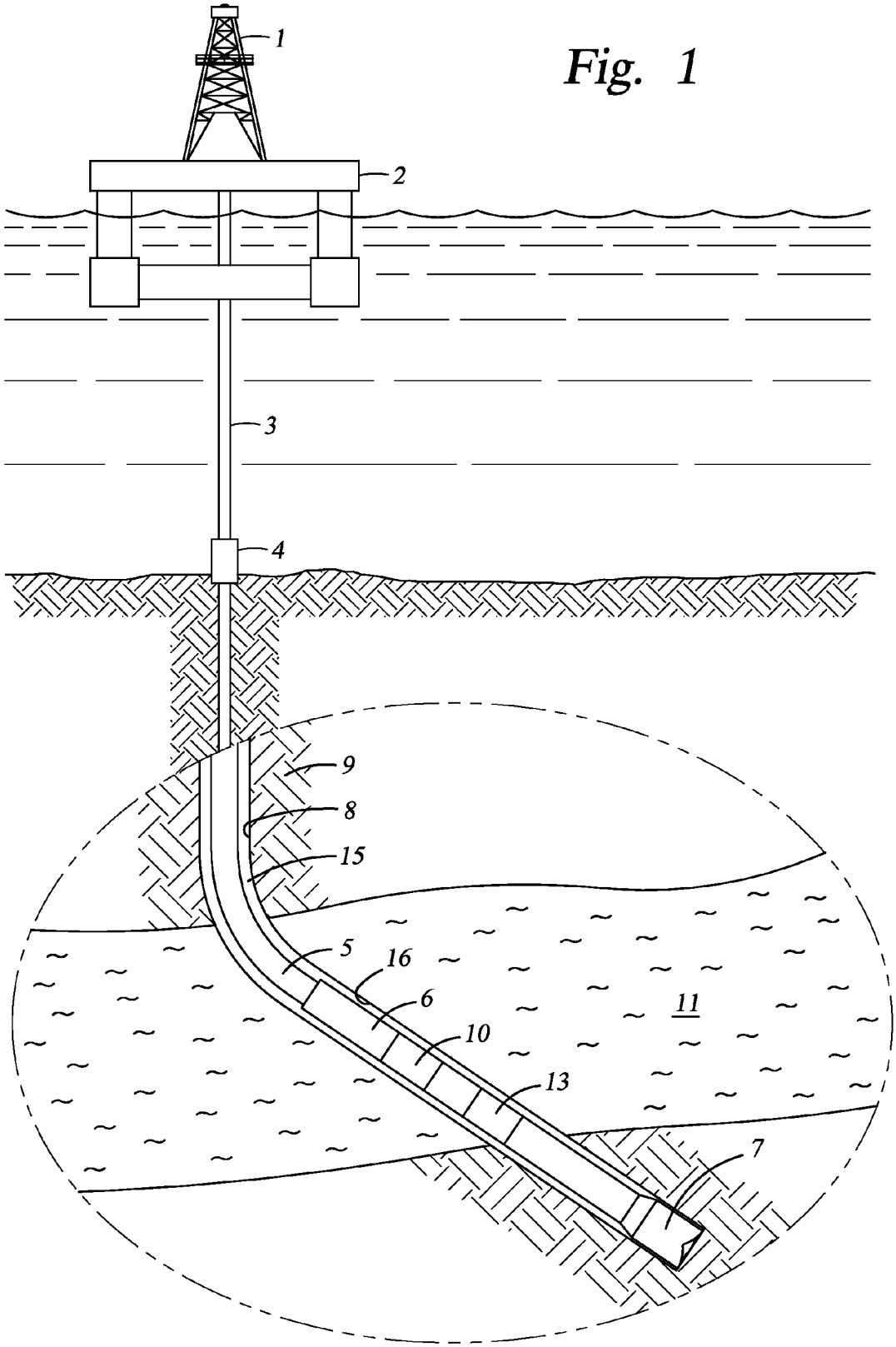
FIG. 1 is a schematic elevation view, partly in cross-section, of an embodiment of a drilling and MWD apparatus disposed in a subterranean well.

In the drawings and description that follows, attempts are made to mark like parts throughout the specification and drawings with the same reference numerals, respectively. The drawing figures are not necessarily to scale. Certain features of the invention may be shown exaggerated in scale or in somewhat schematic form and some details of conventional elements may not be shown in the interest of clarity and conciseness. The present invention is susceptible to embodiments of different forms. Specific embodiments are described in detail and are shown in the drawings, with the understanding that the present disclosure is to be considered an exemplification of the principles of the invention, and is not intended to limit the invention to that illustrated and described herein. It is to be fully recognized that the different teachings of the embodiments discussed below may be employed separately or in any suitable combination to produce desired results. Unless otherwise specified, any use of any form of the terms "connect", "engage", "couple", "attach", or any other term describing an interaction between elements is not meant to limit the interaction to direct interaction between the elements and may also include indirect interaction between the elements described. In the following discussion and in the claims, the terms "including" and "comprising" are used in an open-ended fashion, and thus should be interpreted to mean "including, but not limited to . . . ". Reference to up or down will be made for purposes of description with "up", "upper", "upwardly" or "upstream" meaning toward the surface of the well and with "down", "lower", "downwardly" or "downstream" meaning toward the terminal end of the well, regardless of the well bore orientation. In addition, in the discussion and claims that follow, it may be sometimes stated that certain components or elements are in fluid communication. By this it is meant that the components are constructed and interrelated such that a fluid could be communicated between them, as via a passageway, tube, or conduit. Also, the designation "MWD" or "LWD" are used to mean all generic measurement while drilling or logging while drilling apparatus and systems. The various characteristics mentioned above, as well as other features and characteristics described in more detail below, will be readily apparent to those skilled in the art upon reading the following detailed description of the embodiments, and by referring to the accompanying drawings.

Referring initially to FIG. 1, a MWD tool 10 is shown schematically as a part of a bottom hole assembly 6 which includes an MWD sub 13 and a drill bit 7 at its distal most end. The bottom hole assembly 6 is lowered from a drilling platform 2, such as a ship or other conventional platform, via a drill string 5. The drill string 5 is disposed through a riser 3 and a well head 4. Conventional drilling equipment (not shown) is supported within a derrick 1 and rotates the drill string 5 and the drill bit 7, causing the bit 7 to form a borehole 8 through the formation material 9. The borehole 8 includes a wall surface 16 forming an annulus 15 with the drill string 5. The borehole 8 penetrates subterranean zones or reservoirs, such as reservoir 11, that are believed to contain hydrocarbons in a commercially viable quantity. It is also consistent with the teachings herein that the MWD tool 10 is employed in other bottom hole assemblies and with other drilling apparatus in land-based drilling with land-based platforms, as well as offshore drilling as shown in FIG. 1. In all instances, in addition to the MWD tool 10, the bottom hole assembly 6 contains various conventional apparatus and systems, such as a down hole drill motor, a rotary steerable tool, a mud pulse telemetry system, MWD or LWD sensors and systems, and others known in the art.

Although the various embodiments described herein primarily depict a drill string, it is consistent with the teachings herein that the MWD tool 10 and other components described herein may be conveyed in the borehole 8 via a rotary steerable drill string or a work string, for example. Other conveyances for a tool including the embodiments described herein are contemplated by the present disclosure, and the specific embodiments described herein are used for ease and clarity of description.

Figure 2:
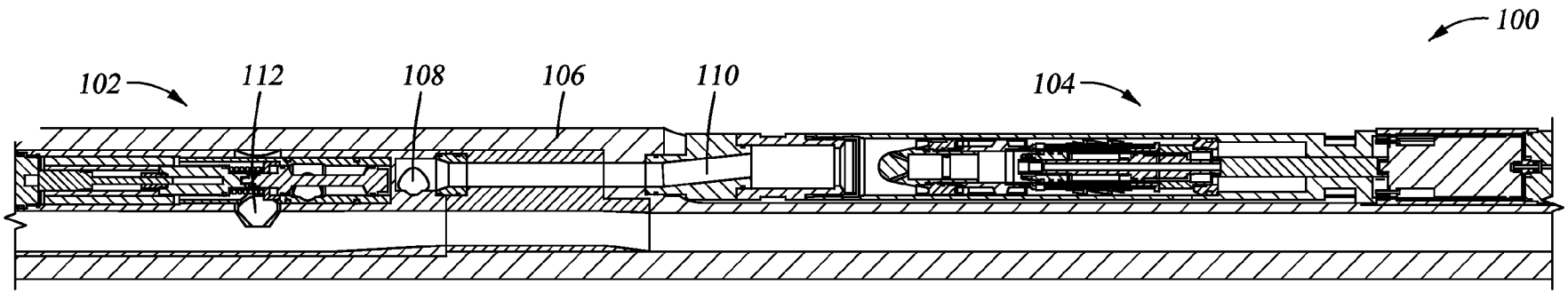
FIG. 2 is a cross-section view of an exemplary embodiment of a flow diverter and power generation assembly.

Referring now to FIG. 2, an exemplary embodiment of a flow diversion and power generation system 100 is shown. At a first end of the system 100 is a flow diversion assembly 102 and at the other end is a power generation assembly 104. The system is shown disposed in a drill collar 106 having a primary drilling fluid flow bore 108 and a diverted or secondary drilling fluid flow bore-110. However, it is consistent with the present disclosure for the system to be disposed in other types of housings to be coupled to a variety of tools and downhole conveyances.

Figure 3A:
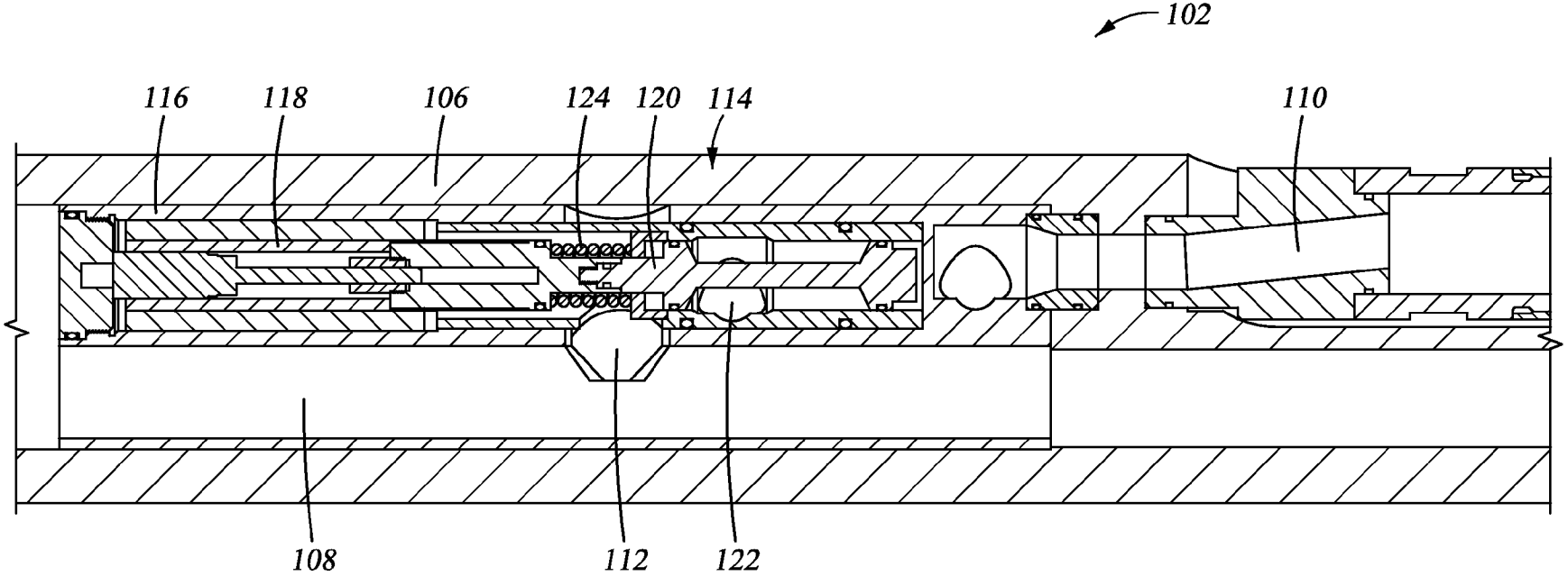
FIG. 3A is an enlarged view of the flow diverter of FIG. 2.

Referring next to FIG. 3A, an enlarged view of the flow diverter assembly 102 of FIG. 2 is shown. The assembly 102 includes a flow diversion port 112 coupled to a valve assembly 114. The valve assembly 114 is connected to the secondary flow bore 110. The valve assembly 114 includes a hydraulic actuation portion 118 and a piston portion 120 having an aperture 122 and a biasing spring 124. The valve assembly 114 is shown in the closed position, meaning the piston portion 120 is maintained in a position where the aperture 122 is out of fluid communication with the primary flow bore 108 and the flow diversion port 112. The hydraulic portion 118 may be selectively actuated to slide the piston portion 120 such that the aperture 122 moves toward the flow diversion port 112. As the aperture 122 begins to overlap the flow diversion port 112, fluid flow in the primary fluid flow bore 108 begins to divert to the flow diversion port 112 and the aperture 122. As the aperture 122 continues to be aligned with the flow diversion port 112, more fluid flows from the primary flow bore 108, into the flow diversion port 112, through the aperture 122, and into a passageway (not shown) that ultimately connects to the secondary flow bore 110 (this pathway of connection between flow bore 108 and flow bore 110 may also be called the diversion flow path). When the flow diversion port 112 and the aperture 122 are fully aligned, a significant portion of the fluid flow in the flow bore 108 is diverted to the flow bore 110. The piston portion 120 can be actuated back and forth to open and close the diversion flow path, and also to regulate the flow rate passing through the diversion flow path. The present disclosure is not limited by the valve embodiment just described, as other valve embodiments can be used to open, close and regulate the diversion flow path.

Figure 3B:
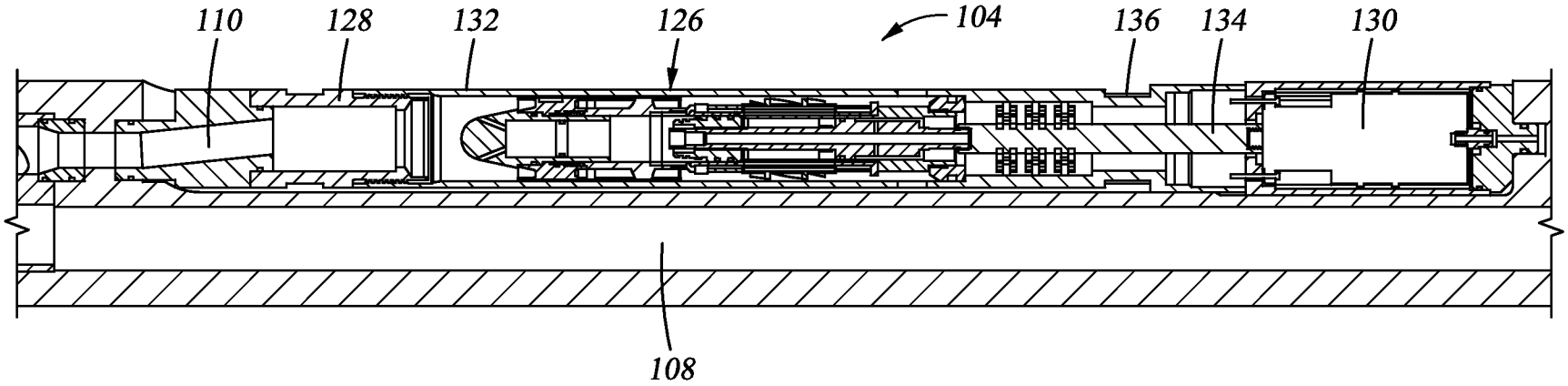
FIG. 3B is an enlarged view of the power generation assembly of FIG. 2.

Referring now to FIG. 3B, an enlarged view of the power generation assembly 104 is shown. The assembly 104 includes a housing 132 having a turbine 126 mounted therein and a receiving end 128 coupled to the secondary flow bore 110. The primary flow bore is disposed adjacent the turbine 126. The housing 132 includes an exit port 136 and the turbine 126 includes a drive member 134 coupled to a pump 130. As previously described, some of the fluid in the primary flow bore 108 is divertable to the flow bore 110, such fluid being communicated to the receiving end 128. The fluid flow then passes through the turbine 126, causing its internal components to rotate and drive the member 134 and, in turn, the pump 130. The pump 130 may be used to provide hydraulic power to other devices coupled to the pump 130. The turbine 126 may likewise be connected to other power devices, such as an electrical generator for producing electrical energy. The fluid flow exits the turbine 126 through the exit port 136, which connects to a borehole annulus or other surrounding environment. The present disclosure is not limited to the turbine embodiments described and shown herein, as other turbines and devices wherein the kinetic energy of a moving fluid is converted to mechanical power by the impulse or reaction of the fluid with a series blades, vanes, buckets or paddles, for example, arrayed about the circumference of a wheel or cylinder are contemplated by the present disclosure.

Although the flow diverter assembly 102 is shown coupled to and communicating with the power generation assembly 104, it is contemplated herein that other embodiments include connecting the flow diverter assembly 102 with other components of a downhole tool. The flow diverter assembly 102 is not intended solely for a power generation apparatus, but for any combination of tool components wherein selective and variable flow diversion may be required.

Figure 4:
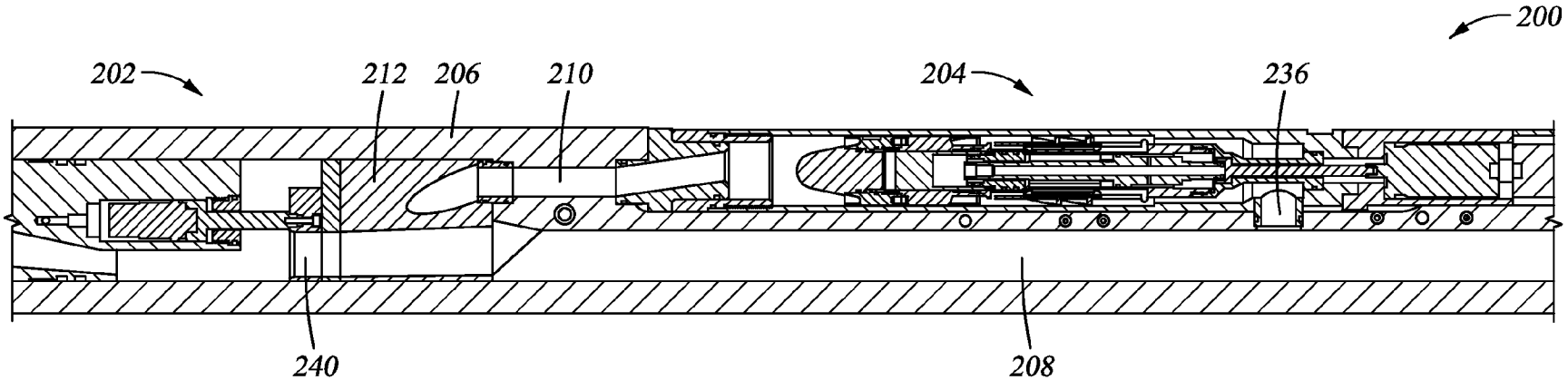
FIG. 4 is a cross-section view of another exemplary embodiment of a flow diverter and power generation assembly.

Referring next to FIG. 4, another embodiment of a flow diversion and power generation apparatus is shown. The apparatus 200 includes a flow diversion assembly 202 and a power generation assembly 204. A drill collar 206 houses a diversion manifold 212, a primary flow bore 208 and a secondary or diverted flow bore 210. The flow diversion assembly 202 is different from the sliding piston valve type assembly 102 of FIGS. 2 and 3A, as will be described below.

Figure 5A:
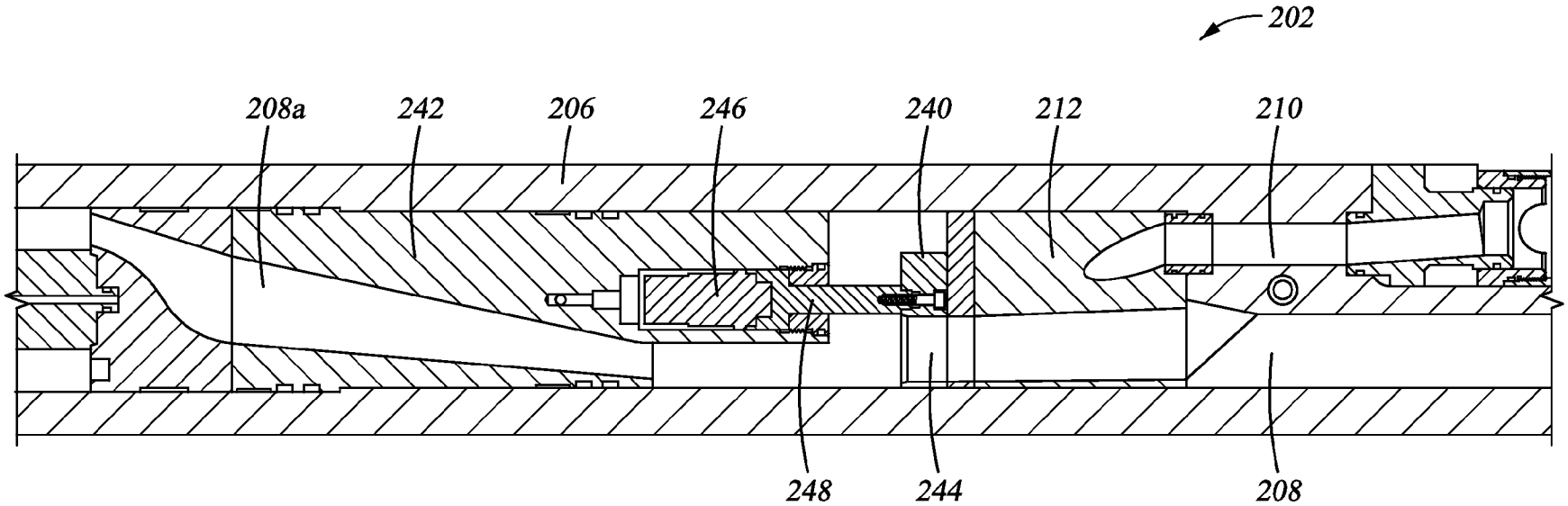
FIG. 5A is an enlarged view of the flow diverter of FIG. 4.

Referring now to FIG. 5A, an enlarged view of the flow diversion assembly 202 is shown. The drill collar or housing 206 houses an insert 242 having an extension 208*a* of the primary fluid flow bore 208. A manifold 212 is also mounted in the drill collar 206, having connections to the flow bores 208, 210 and a plate or disc 240 having an aperture 244. The insert 242 includes a control mechanism 246, such as a motor, coupled to the plate 240 via drive member 248. The mechanism 246 rotates the member 248 to then rotate the plate 240.

Figure 5B:
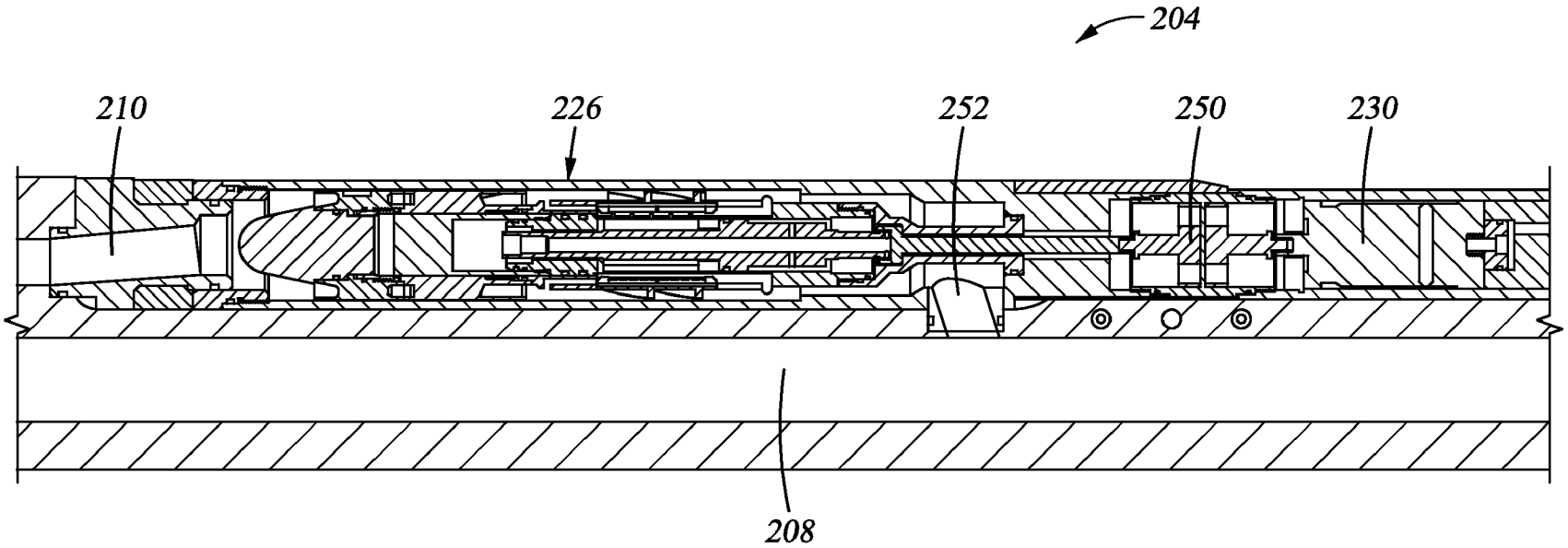
FIG. 5B is an enlarged view of the power generation assembly of FIG. 4.

Referring now to FIG. 5B, an enlarged view of the power generation assembly 204 is shown. The assembly 204 is similar to the assembly 104, with a few differences. The assembly 204 includes a turbine or flow gear 226 to receive diverted fluids from the flow bore 210, but also includes an exit port 252 for redirecting the diverted fluids back into the primary flow bore 208. Thus, in one embodiment the diverted fluid is ultimately directed into the annulus while, in another embodiment, the diverted fluid is directed back into the primary flow bore. Further, a magnetic coupling 250 detachably couples the turbine 226 to a pump 230. The magnetic coupling allows the turbine 226 to be easily removed from the pump 230 and replaced.

Figure 6:
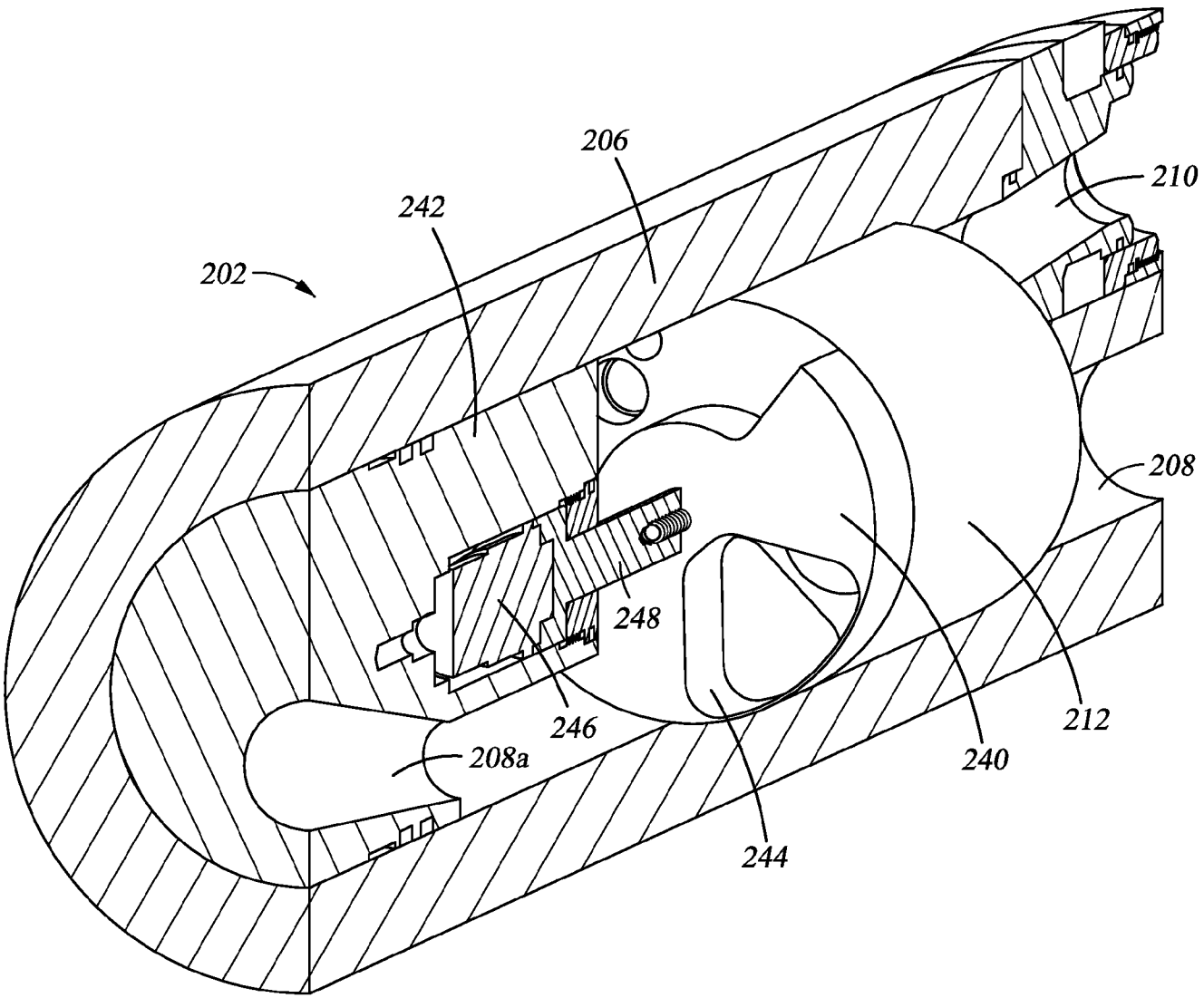
FIG. 6 is an enlarged, perspective view of a portion of the flow diverter of FIGS. 4 and 5A.

Referring now to FIG. 6, a perspective view of the assembly 202 is shown. The rotating plate 240 having aperture 244 is shown coupled between the manifold 212 and the insert 242.

Figure 7A:
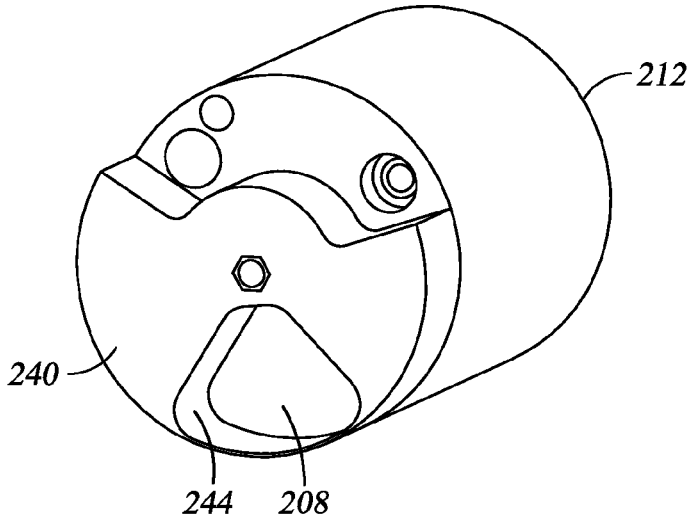
FIGS. 7A-7C are perspective views of various positions of the rotating plate and manifold assembly of the embodiment of FIG. 6.
Figure 7B:
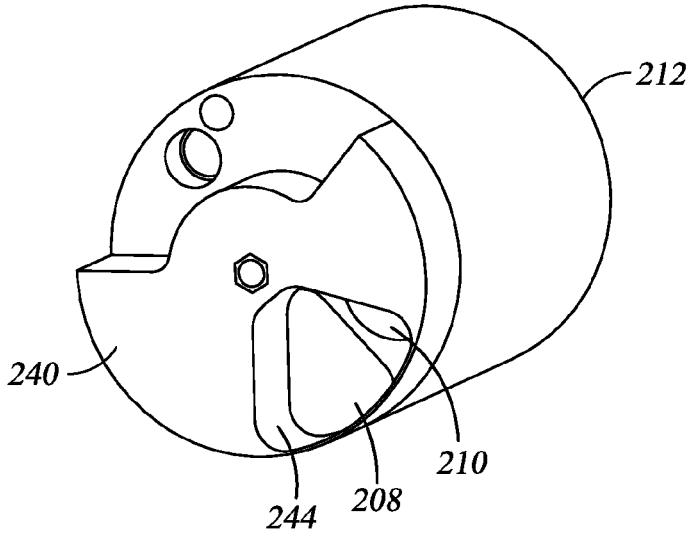
Figure 7C:
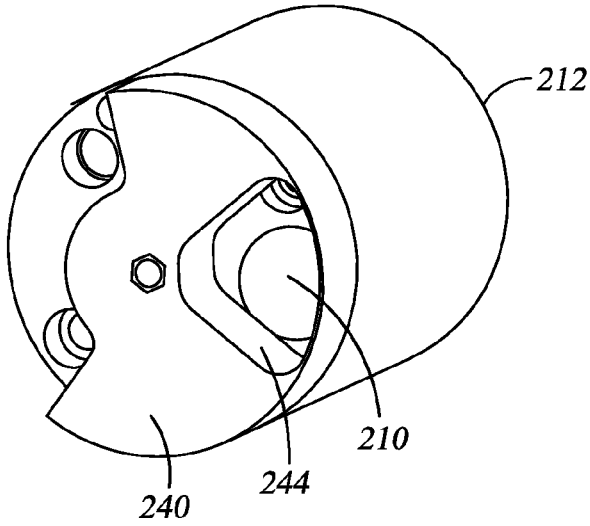

Referring next to FIGS. 7A-7C, different perspective views of the rotating plate and manifold assembly are shown. In FIG. 7A, the plate 240 is positioned such that the aperture 244 is aligned with the flow bore 208 and all flow through the assembly is through the primary fluid flow bore 208. In FIG. 7B, the rotary control mechanism is actuated and the plate 240 is rotated slightly such that the aperture 244 is misaligned with the flow bore 208, and partially aligned or overlapping with both the flow bore 208 and the secondary flow bore 210. Part of the primary drilling fluids are directed into the flow bore 210 and into the turbine 226 for power generation. The position of the plate 240 shown in FIG. 7B can be adjusted slightly to vary the flow rate of the fluids into the diversion flow bore 210. As shown in FIG. 7C, the plate 240 can be rotated to its final position to close off the primary flow bore 208 and direct all of the primary drilling fluids into the secondary flow bore 210 and the turbine 226 for power generation. As previously mentioned, the redirected or diverted fluid flow can be channeled to other devices other than those shown for power generation.

The embodiments of the flow diverter described herein are selectively usable and adjustable so as to vary the flow rate that is diverted. Certain embodiments also include a feedback and control mechanism for communicating the information necessary to determine when the flow diverter is to be used, and when the flow rate is to be varied. The flow rate to the turbine is controlled by the diverter, and the flow rate determines the speed (in rotations per minute, RPM) of the turbine and thus the power output. In one embodiment, for example, the pressure from the pumps connected to the turbine plus the speed of the turbine can be monitored as feedback for determining when the diverter need be adjusted. If multiple components of the tool are being used, and there is a power drain on the system, this feedback will reflect such circumstances and allow the diverter to be adjusted for more flow rate and thus more power from the turbine. The position of the diverter valve or rotating plate can also be monitored as feedback. If an electrical generator is coupled to the turbine, a voltage and current on the alternator may be monitored. If a pump is likewise connected to the turbine, speed and pressure can be monitored in conjunction with voltage and current. In addition to mechanical, hydraulic or electrical loads on the power generation assembly, temperature can be used as a feedback information.

Figure 8:
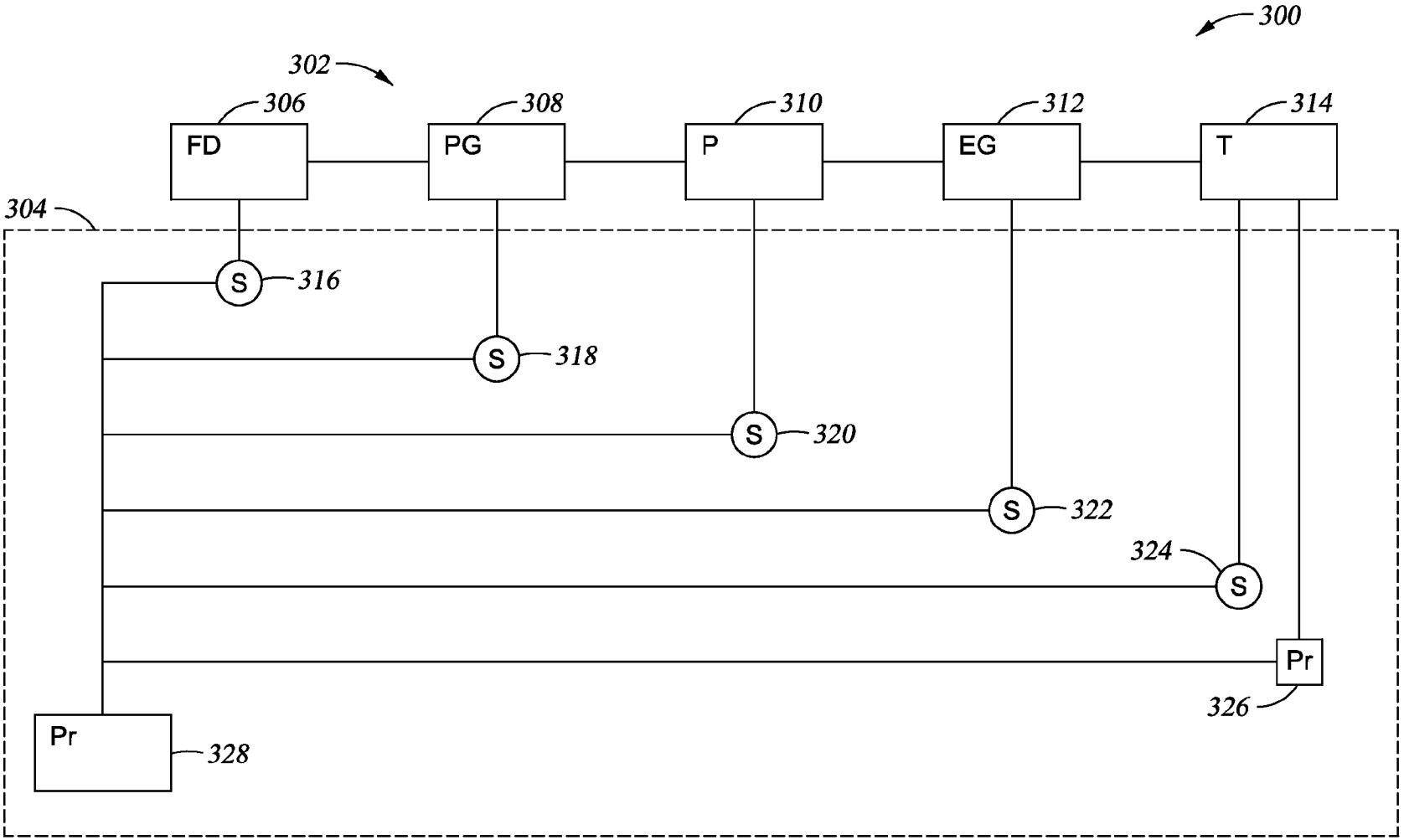
FIG. 8 is a schematic of an exemplary embodiment of a flow diversion system.

Referring now to FIG. 8, a schematic drawing shows a combination of various embodiments of a flow diverter, power generation assembly and feedback and control mechanism. A flow diversion system 300 includes a flow diversion and power assembly 302 and a feedback and control system 304. The assembly 302 includes a flow diverter 306, a power generation assembly 308, a pump 310, an electrical generator 312 and a tool 314 consistent with the various embodiments described herein, and adaptable for various combinations of these components. The feedback and control system 304 includes a flow diverter sensor 316, a power assembly sensor 318, a pump sensor 320, an electrical generator sensor 322, a tool sensor 324 and a tool processor 326 coupled to their associated components as shown. The sensors are coupled to a feedback processor 328, which includes various known processors and may be disposed in various locations, such as in the assemblies 100, 200, the MWD tool 10, other components of the bottom hole assembly 6, or at the surface of the well.

The sensors include a variety of specific sensors. For example, the sensor 316 is a position indicator for a valve or rotating plate as described herein, the sensor 318 is a sensor for detecting the speed of a turbine, the sensor 320 is a pressure sensor, the sensor 322 indicates voltage and current of the electrical generator 312, and the sensor 326 is another pressure sensor or another of a variety of sensors found in the downhole tool 314. The processor 326 may contain feedback information, such as an algorithm for a formation or fluid ID test sequence. The sensors detect certain properties and communicate them to the processor 328, which may include a baseline of the property for comparison to the measured property. For example, in one embodiment, the processor 328 includes a predetermined range of baseline speeds for a turbine in the power assembly 308. The sensor 318 measures a property of the turbine, such as the speed in RPM of the turbine, and the measured speed is compared to the stored baseline speed to determine whether the actual speed of the turbine is within the predetermined range of the baseline. If not, the flow diverter 306 is adjusted to vary the diversion path flow rate. Thus, the flow diverter is variable in response to a determination that a property is not within a predetermined range of a baseline. A similar process may be executed for measured properties of the electrical generator, such as voltage and current, or for other properties of the components previously described.

In another embodiment, the speed of the turbine in the power assembly 308 may be measured by the sensor 318, and the pressure of the pump 310 may be measured by the sensor 320. The speed and pressure measurements may be used to obtain the power output to the tool 314. Further, the feedback processor 328 may communicate with a test sequence in the tool processor 326 to anticipate an increase or decrease in the amount of power to be used by the tool 314 in the near future. For example, the processor 326 can indicate that actuation of several hydraulically powered members is to be executed in five seconds. The processor 328 will receive this feedback information, and direct the flow diverter to open, or further open, the flow diversion path to increase the fluid flow rate and thus the power output of the power assembly 308.Thus, the variable flow diverter can be actuated in anticipation of a known event. Other embodiments include other feedback information as disclosed herein.

Figure 9:
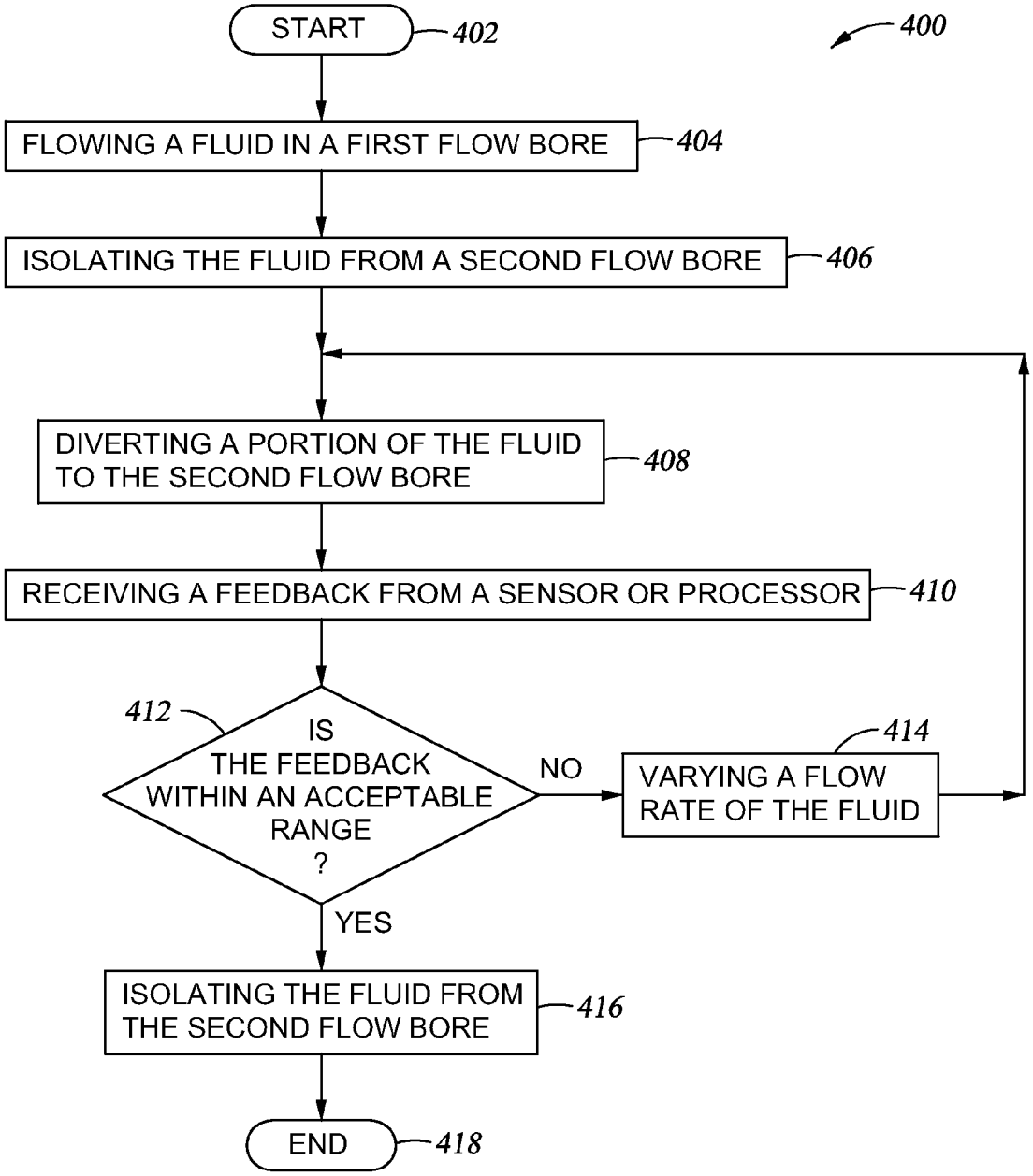
FIG. 9 is a block diagram of an exemplary embodiment of a method for flow diversion.

Referring now to FIG. 9, a block diagram of exemplary embodiments of a method 400 is shown. In one embodiment, the method 400 starts at a block 402. At a block 404, a fluid is flowed in a first flow bore. Isolating the fluid from a second flow bore is indicated at a block 406. Diverting a portion of the fluid flow to the second flow bore is indicated at a block 408. Receiving a feedback from a sensor or processor, as described in various embodiments described herein, is indicated at a block 410. At a block 412, is the feedback within an acceptable range, or is a feedback including a property within a predetermined range of a baseline of the property, as described in embodiments herein. If "NO," a block 414 indicates varying a flow rate of the fluid directed into the second flow bore. The process is then directed back to the block 408. If "YES," the embodiments of the flow diverter as described herein may be closed, isolating the fluid form the second flow bore as indicated at a block 416. The process ends at a block 418.

Other embodiments include various combinations of the components of the exemplary process 400, and still further embodiments include additional components of the embodiments described elsewhere herein. For example, in an alternative embodiment of the method 400, if it is known that a certain quantity of power is needed, the process may skip from the block 408 to the block 416 to simply provide the predetermined quantity of power. The variable diverter allows the predetermined quantity of power to be adjusted, as the embodiments described herein allow the position of the diverter to be chosen, and thus the flow rate and power chosen also. In yet another embodiment, as previously described, the feedback may include the beginning or end of a known event, and thus the method 400 may be adjusted such that the block 410 skips to the block 414, with the block 416 always being an option to end the flow diversion and power generation.

Positioning the turbine in the secondary flow bore and providing a selectively usable and variable flow diverter reduces wear on the turbine and the pump. If drilling is commencing 90 percent of the time downhole, whereas generating power for a fluid ID system or formation tester, for example, commences 10 percent of the time, the fluid flow is only affecting the turbine 10 percent of the time. Further, a variable diverter adds a control element to the speed of the turbine, whereas an all or nothing flow through the turbine provides no speed control and therefore adds complexity to the controls of the entire system. Because certain of the embodiments including a power generation assembly described herein provide a robust power supply and variability of that power supply, the embodiments are well adapted to provide all of the power needed for the complex and sizeable tools referenced herein. For example, power sources dependent on surface interaction, such as disposable batteries charged at the surface, can be eliminated.

While specific embodiments have been shown and described, modifications can be made by one skilled in the art without departing from the spirit or teaching of this invention. The embodiments as described are exemplary only and are not limiting. Many variations and modifications are possible and are within the scope of the invention. Accordingly, the scope of protection is not limited to the embodiments described, but is only limited by the claims that follow, the scope of which shall include all equivalents of the subject matter of the claims.

What is claimed is:

1. An apparatus comprising:

a housing having a first flow bore and a second flow bore, said first flow bore having a drilling fluid flowing therein;

a device disposed in said second flow bore to receive a fluid flow;

a diverter disposed between said first and second flow bores, said diverter having a first position preventing the drilling fluid from flowing into said second flow bore and a second position allowing a portion of the drilling fluid to flow into said second flow bore and through said device; and a feedback and control mechanism coupled to said diverter and responsive to at least one of said second position and said fluid flow in said second flow bore.

2. The apparatus of claim 1 wherein said diverter further comprises a plurality of positions, each of said positions allowing a different flow rate into said second flow bore.

3. The apparatus of claim 1 wherein said diverter is adapted to vary the drilling fluid flow from said first flow bore to said second flow bore.

4. The apparatus of claim 1 wherein said diverter is selectively actuatable.

5. The apparatus of claim 2 wherein one of said positions comprises allowing all of the drilling fluid to flow into said second flow bore.

6. The apparatus of claim 1 wherein said feedback and control mechanism includes a measured property and a processor to adjust the position of said diverter in response to said measured property.

7. The apparatus of claim 1 wherein a feedback comprises at least one of a pressure from a pump coupled to a turbine, an RPM of said turbine, a voltage from an electrical generator coupled to said turbine, a current from said electrical generator, a temperature and a mechanical load on said pump.

8. The apparatus of claim 1 wherein said device is a turbine adapted to provide at least one of electrical power, mechanical power and hydraulic power to an MWD tool coupled to said housing.

9. The apparatus of claim 8 wherein all power to said MWD tool comes from said turbine.

10. An apparatus comprising:

a drill collar having a first flow bore and a second flow bore, said first flow bore having a drilling fluid flowing therein;

a power generation assembly disposed in said second flow bore;

a flow diverter isolating the drilling fluid from said second flow bore in a first position;

wherein said flow diverter includes a variable second position directing the drilling fluid into said second flow bore at a variable flow rate; and a control mechanism disposed in the drill collar and coupled to the flow diverter to vary the flow diverter second position and the variable flow rate to said power generation assembly.

11. The apparatus of claim 10 further comprising a processor coupled to said power generation assembly and said flow diverter, said processor including a baseline of a property of said power generation assembly.

12. The apparatus of claim 11 wherein said processor is configured to compare a measured property of said power generation assembly to said baseline to determine whether said measured property is within a predetermined range of said baseline, and said second position is variable in response to said determination that said property is not within said predetermined range of said baseline.

13. The apparatus of claim 12 wherein said measured property comprises at least one of a mechanical load on said power generation assembly, an electrical load on said power generation assembly and a hydraulic load on said power generation assembly.

14. The apparatus of claim 10 wherein said power generation assembly comprises at least one of a turbine, a hydraulic pump, an electrical generator and a magnetic coupling.

15. The apparatus of claim 10 wherein said second position is variable to vary the flow rate to a turbine in said power generation assembly in response to the power needs of an MWD tool coupled to said drill collar.

16. An apparatus comprising:

a drill collar having a first flow bore with a first drilling fluid flow therein, and a second flow bore isolated from said first drilling fluid flow and having a power generation assembly disposed therein;

a flow diverter adapted to direct a variable second drilling fluid flow into said second flow bore; and an MWD tool coupled to said drill collar and said power generation assembly;

wherein said variable second drilling fluid flow generates a variable power supply in said power generation assembly, said variable power supply providing substantially all power to said MWD tool.

17. The apparatus of claim 16 wherein said second drilling fluid flow is variable in response to a known event of said MWD tool.

18. A method of diverting a fluid flow in a downhole tool comprising:

flowing a fluid through a first flow bore in the downhole tool;

isolating the fluid from a second flow bore in the downhole tool;

diverting a portion of the fluid to the second flow bore using a diverter positioned between the first and second flow bores; and receiving a feedback in the downhole tool in response to diverting the fluid to the second flow bore using the diverter.

19. The method of claim 18 further comprising:

varying a flow rate of the fluid diverted to the second flow bore in response to the feedback.

20. The method of claim 18 further comprising:

adjusting the diverted fluid portion in response to the feedback.

21. The method of claim 19 further comprising:

varying a power output of the downhole tool in response to varying the flow rate.

* * * * *